US009708775B2

(12) United States Patent
Bos et al.

(10) Patent No.: US 9,708,775 B2
(45) Date of Patent: Jul. 18, 2017

(54) RAILWAY

(71) Applicants: Movares Nederland B.V., Utrecht (NL); Koninklijke Bam Groep N.V., Bunnik (NL)

(72) Inventors: Jelte Annee Bos, Utrecht (NL); Jozef Aloysius Maria Jansen, Bunnik (NL)

(73) Assignees: MOVARES NEDERLAND B.V., Utrecht (NL); KONINKLIJKE BAM GROEP N.V., Bunnik (NL)

( * ) Notice: Subject to any disclaimer, the term of this patent is extended or adjusted under 35 U.S.C. 154(b) by 114 days.

(21) Appl. No.: 14/599,219

(22) Filed: Jan. 16, 2015

(65) Prior Publication Data

US 2015/0129671 A1 May 14, 2015

Related U.S. Application Data

(63) Continuation of application No. PCT/NL2013/050543, filed on Jul. 17, 2013.

(30) Foreign Application Priority Data

Jul. 20, 2012 (NL) ..... 2009217

(51) Int. Cl.
*E01B 9/42* (2006.01)
*E01B 9/32* (2006.01)
(Continued)

(52) U.S. Cl.
CPC ..... *E01B 9/32* (2013.01); *E01B 9/46* (2013.01); *E01B 9/486* (2013.01)

(58) Field of Classification Search
CPC ..... E01B 9/00; E01B 9/02; E01B 9/38; E01B 9/40; E01B 9/42; E01B 9/44; E01B 9/46;
(Continued)

(56) References Cited

U.S. PATENT DOCUMENTS 3,826,424 A * 7/1974 McClung ..... E01B 9/28 238/264
4,275,832 A 6/1981 Kenyon

FOREIGN PATENT DOCUMENTS

DE 860806 12/1952
DE 2315720 10/1974
(Continued)

*Primary Examiner* — R. J. McCarry, Jr.
(74) *Attorney, Agent, or Firm* — Peacock Myers, P.C.; Jeffrey D. Myers

(57) ABSTRACT

A railway comprising rails that are at least in part at regular places along their longitudinal direction supported by and mounted on baseplates, wherein each baseplate is fixed to a sleeper resting on ballast, and wherein each rail is clamped to the baseplate with a clamping plate that is fitted to the baseplate with a clamping bolt, and which clamping plate has opposite extremities of which a first extremity rests on a cam provided on the baseplate and a second extremity rests on and presses the rail to the baseplate, wherein the first extremity and the cam have first contact surfaces and the second extremity and the rails have second contact surfaces, wherein the first contact surfaces and the second contact surfaces each have imaginary perpendicular lines that cross each other at an imaginary center line of the clamping bolt.

5 Claims, 4 Drawing Sheets

(51) Int. Cl.
*E01B 9/46* (2006.01)
*E01B 9/48* (2006.01)

(58) Field of Classification Search
CPC ..... E01B 9/48; E01B 9/54; E01B 9/60; E01B 9/62; E01B 9/66
See application file for complete search history.

(56) References Cited

FOREIGN PATENT DOCUMENTS

| | | |
|---|---|---|
| DE | 2421092 | 11/1975 |
| EP | 0169187 | 1/1986 |
| EP | 0233032 | 8/1987 |
| EP | 2339068 | 6/2011 |
| GB | 142881 | 5/1920 |
| GB | 841423 | 7/1960 |
| WO | 96/27708 | 9/1996 |
| WO | 2014/015352 | 1/2014 |

* cited by examiner

RAILWAY

CROSS-REFERENCE TO RELATED APPLICATIONS

This application is a continuation application of Patent Cooperation Treaty Application No. PCT/NL2013/050543, filed on Jul. 17, 2013, which claimed priority to Netherlands Patent Application No. 2009217, filed on Jul. 20, 2012, and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

Field of the Invention (Technical Field)

The present invention relates to a railway comprising rails that are at least in part at regular places along their longitudinal direction supported by and mounted on supporting pads or baseplates, wherein each baseplate is fixed to a sleeper resting on ballast, and wherein each rail is clamped to the baseplate with a clamping plate that is fitted to the baseplate with a clamping bolt, and which clamping plate has opposite extremities of which a first extremity rests on a cam provided on the baseplate and a second extremity rests on and presses the rail to the baseplate.

Description of Related Art

EP-A-2 339 068 addresses the known problem of existing railways that the support of neighboring or adjacent railway parts may vary depending on the deterioration of the ballast, particularly although not exclusively shortly after establishing a new railway. The problem is also existent with older railways, and is connected with the deterioration of the supporting structure of the sleepers which may be different for the first railway part and an adjacent second railway part. The problem is particularly prominent when the first railway part rests on ballast, and the second adjacent railway part rests on a more fixed structure such as concrete, as may be the case at a railway crossing. Over time the ballast may become more dense, and this deterioration is promoted by the regularly passing trains, which in turn will result in accelerated densification of the ballast. The ballast getting more dense may even eventually result in that the sleepers will no longer be supported by ballast, but will be hanging from the rail. This is very detrimental to passenger comfort, and may result even in rail failure.

EP-A-2 339 066 addresses these problems by applying two replaceable filler parts that are placed on top of each other that together exhibit a thickness in the vertical direction that matches and fills the room or space between the rail and the sleeper so as to cause that the rail is maintained at a pre-established level. Accordingly in EP-A-2 339 066 the room or space between the rail and the baseplate is selectable at a predefined measure corresponding to a selectable height of the rail between a first lowest position of the rail and a second highest position of the rail, wherein in the lowest position of the rail the first extremity of the clamping plate resting on the cam is above the second extremity of the clamping plate resting on the rail, and wherein in the highest position of the rail the first extremity of the clamping plate resting on the cam is below the second extremity of the clamping plate resting on the rail so as to arrange that with variation of the height of the rail the clamping plate rotates having its center of rotation on top of the cam. The clamping plate thus makes an angular movement.

A first and a second of the two replaceable filler parts are each embodied as wedges sloping in the longitudinal direction of the rail and have matching oblique contacting surfaces, whereby in use the oblique surfaces of the first wedge and the second wedge rest on each other so as to cause that opposed surfaces of the first wedge and the second wedge that contact the rail and the sleeper, respectively are substantially horizontal. Further the wedges have in the longitudinal direction of their oblique contacting surface regularly distributed depressions transverse to the longitudinal direction of the rail so as to arrange that in said longitudinal direction the oblique contacting surface of each wedge is shaped as a series of connected sloping surface-parts. This makes it easy to adjust for the dimensions of the room or space between the rail and the sleeper, also when these dimensions do not exactly match the available thickness groups of the filler parts, whilst the cooperating depressions on the contacting surfaces of the abutting wedges provide security against longitudinal movement of these wedges which might otherwise cause that the support of the rails by the ballast is lost. Another benefit of the solution disclosed in EP-A-2 339 066 is that it is easily possible to adjust to the room or space—also afterwards—that possibly develops over time between the rail and the sleeper, whilst the sleeper can remain supported by the underlying structure, notably the ballast.

A problem that may exist that is due to the load exerted by passing trains is that the parts of the railway are subjected to repeated deformation. These deformations result in small but repeated movements of the parts of the railway with respect to each other. In the known railway the baseplate may then repeatedly frictionally engage the guide or guides that keep it in place, which is to be avoided.

Another problem is that the repeated deformation of the railway may cause that the filler parts, particularly the lowest filler part that rests on the baseplate moves out of position.

Still another problem is that the application of the filler parts to ensure that the rail is maintained on the required height, may result in track gauge narrowing with increasing height of the rails.

BRIEF SUMMARY OF THE INVENTION

It is an object of the invention to address the above mentioned problems, and to this end the railway of the invention has the features of one or more of the appended claims Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
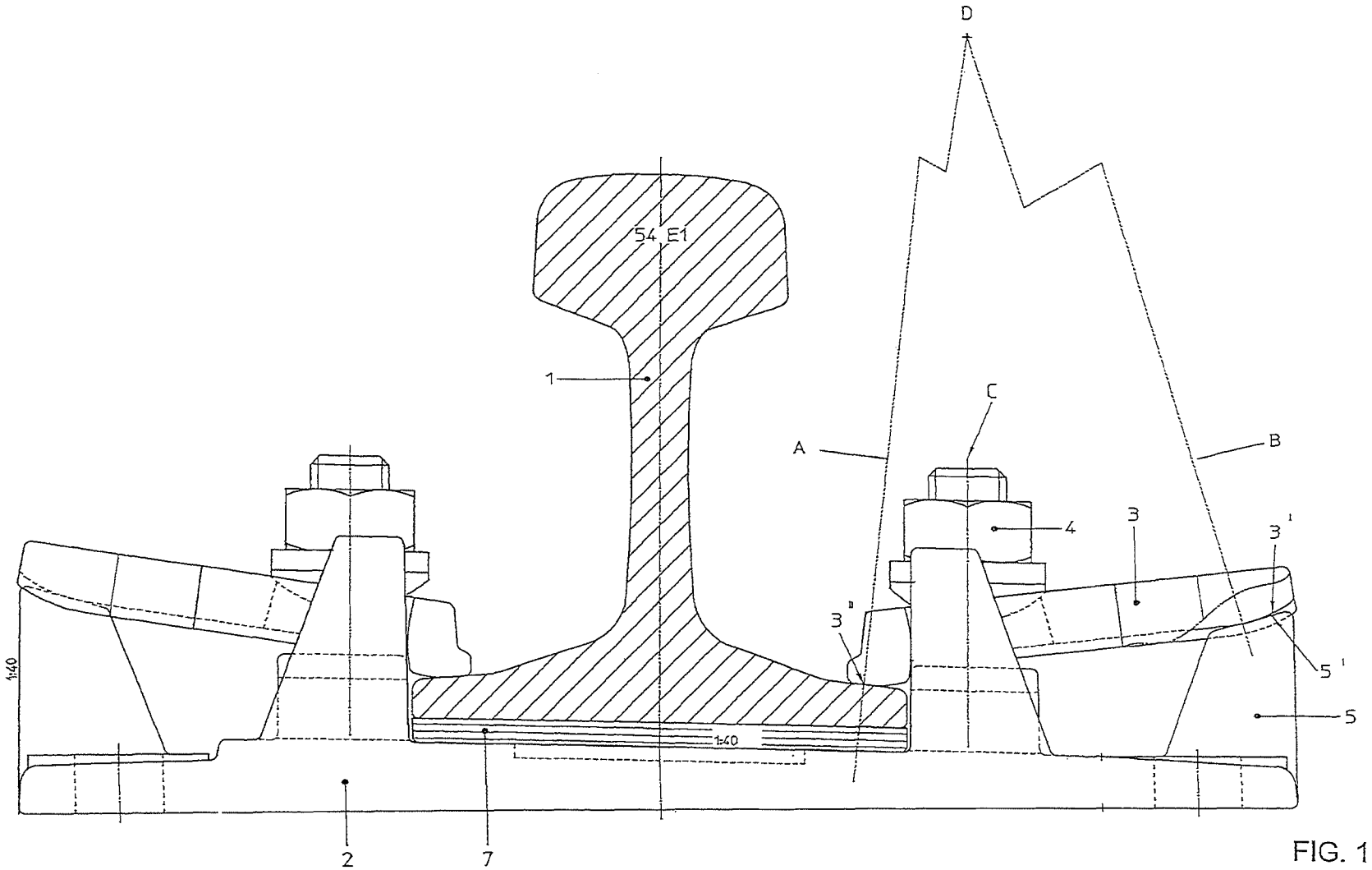
FIG. 1 shows a cross-sectional view of a part of a railway.

In a first aspect of the invention the contact surface of the cam has an upwards inclination away from the rail so that with variation of the height of the rail from its first lowest position to its second highest position, a position where the first extremity of the clamping plate rests on the cam is made to shift upwards and away from the rail. This arranges that with the first extremity of the clamping plate and the cam sharing first contact surfaces and the second extremity of the clamping plate and the rails sharing second contact surfaces, imaginary perpendicular lines of said first contact surfaces and said second contact surfaces are made to cross each other at an imaginary center line of the clamping bolt. With this measure it is prevented that movements of the respective parts of the railway will result in shear forces between each of the mentioned contact surfaces.

Desirably further the cam is provided on the baseplate at a far end from the rail. This enables that even with large variations in the height of the rail, the angular movement of the clamping plate remains at a comparatively low value.

The limited angular movement of the clamping plate is supported by the feature that the contact surface of the cam has an upwards inclination away from the rail. This causes that with increasing height of the rail also the extremity of the clamping plate that rests on the cam is established at a higher level.

Another aspect of the invention which can be applied in combination or separate from the other features discussed herein, relates to the embodiment of the railway, wherein between each rail and the baseplate on the sleeper there are at least two replaceable filler parts that are placed on top of each other and together exhibit a thickness in the vertical direction that matches and fills a room or space between the rail and the sleeper so as to cause that the rail is maintained at a pre-established level. This embodiment is preferably provided with the feature that the filler part that immediately rests on the baseplate, and the baseplate have a cooperating protrusion and receptacle for the protrusion. This prevents relative movements of the filler part that rests on the baseplate.

Still another aspect of the invention that can be applied in combination or separate from the other features discussed herein, relates to the embodiment of the railway wherein the baseplate is provided with upstanding flanges between which the rail is placed. This embodiment has the feature that the upstanding flanges are oblique with respect to an upper surface of the baseplate so as to arrange that in use the flange's sidewalls adjacent to the rail are oriented perfectly perpendicular to the horizon. This has the technical effect that with increasing height of neighboring rails their mutual distance remains the same so as to avoid undesirable track gauge narrowing.

According to still a further aspect of the invention that can be applied separate or in combination with the other features discussed herein, relates to an embodiment of the railway wherein a first and a second of the two replaceable filler parts are each embodied as wedges sloping in the longitudinal direction of the rail with matching oblique contacting surfaces, wherein the oblique surfaces of the first wedge and the second wedge rest on each other so as to cause that opposed surfaces of the first wedge and the second wedge that contact the rail and the baseplate on the sleeper are substantially horizontal. In this embodiment the said oblique surfaces are provided with a rough contact surface. This counteracts undesirable movements of the wedges, also when the rail moves relative to the sleeper.

The invention will hereinafter be further elucidated with reference to the appended drawings of an example of a railway of the invention that does not limit the appended claims.

Referring first to FIG. 1 a part of a railway is shown, comprising rails 1 that are at least in part at regular places along their longitudinal direction supported by and mounted on baseplates 2, wherein each baseplate 2 is fixed in known manner to a sleeper resting on ballast. The way this is done is completely known to the person skilled in the art and need therefore not be shown in the drawing.

Each rail 1 is clamped to the baseplate 2 with a clamping plate 3 that is fitted to the baseplate 2 with a clamping bolt 4. The clamping plate 3 has opposite extremities 3', 3" of which a first extremity 3' rests on a cam 5 provided on the baseplate 2 and a second extremity 3" rests on and presses the rail 1 to the baseplate 2.

As FIG. 1 further shows the cam 5 is provided on the baseplate 2 at a far end from the rail 1, meaning that the cam 5 is placed as distant as possible from the rail 1. Further FIG. 1 shows that the contact surface of the cam 5 has an upwards inclination away from the rail 1.

Figure 2:
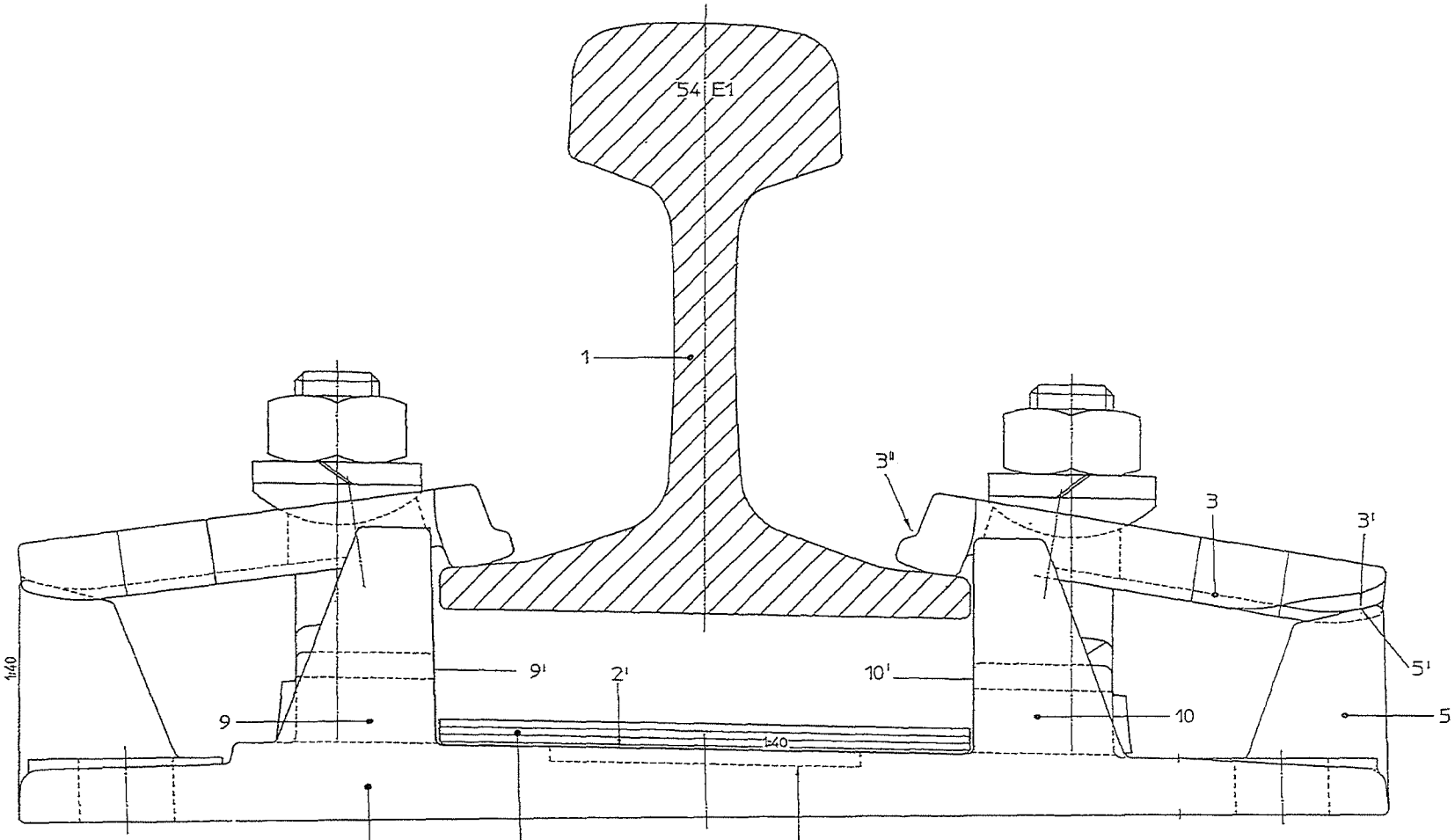
FIG. 2 shows a further cross-sectional view of the part of the railway shown in FIG. 1, provided with several filler parts.

Making now also reference to FIG. 2 it is shown that between the rail 1 and the baseplate 2 on the sleeper there are at least two replaceable filler parts collectively denoted with reference 6, that are placed on top of each other and together exhibit a thickness in the vertical direction that matches and fills a room or space 7 (see FIG. 1) between the rail 1 and the baseplate 2 on the sleeper, so as to cause that the rail 1 can be maintained at a pre-established level. The filler part 6 that immediately rests on the baseplate 2, and said baseplate 2 have a cooperating protrusion and receptacle for the protrusion. The protrusion and the receptacle are together denoted with reference 8 and established at the location of the striped line near the upper surface of the baseplate 2.

In combination FIG. 1 with FIG. 2 show that the room or space 7 between the rail 1 and the baseplate 2 is selectable at a predefined measure corresponding to a selectable height of the rail 1 between a first lowest position of the rail 1 as shown in FIG. 1, and a second highest position of the rail 1 as shown in FIG. 2. In the lowest position of the rail 1 shown in FIG. 1, the first extremity 3' of the clamping plate 3 resting on the cam 5 is above the second extremity 3" of the clamping plate 3 resting on the rail 1. In the highest position of the rail 1 shown in FIG. 2, the first extremity 3' of the clamping plate 3 resting on the cam 5 is below the second extremity 3" of the clamping plate 3 resting on the rail 1. This arranges that with variation of the height of the rail 1 between the positions shown in FIG. 1 and FIG. 2, the clamping plate 3 will rotate having its center of rotation on top of the cam 5.

According to the invention when the height of the rail 1 is varied from its first lowest position shown in FIG. 1 to its second highest position shown in FIG. 2, a position 5' where the first extremity 3' of the clamping plate 3 rests on the cam 5 shifts upwards and away from the rail 1. This means that while the first extremity 3' and the cam 5 have first contact surfaces and the second extremity 3" and the rail 1 have second contact surfaces, the first contact surfaces and the second contact surfaces exhibit imaginary perpendicular lines A, B as shown in FIG. 1, that are made to cross each other at an imaginary center line C of the clamping bolt 4 relatively independent from the height of the rail. The crossing point is indicated with letter D.

Returning now to FIG. 2 it is shown that the baseplate 2 is provided with upstanding flanges 9, 10 between which the rail 1 is placed. The upstanding flanges 9, 10 are oblique with respect to an upper surface 2' of the baseplate 2 so as to arrange that in use the flange's sidewalls 9', 10' adjacent to the rail 1 are oriented perfectly perpendicular to the horizon.

Finally with reference to FIGS. 3A-C and 4A-C a first and a second of the two replaceable filler parts are shown that are each embodied as wedges 11, 12 sloping in a direction that corresponds to the longitudinal direction of the rail 1.

Figure 3A:
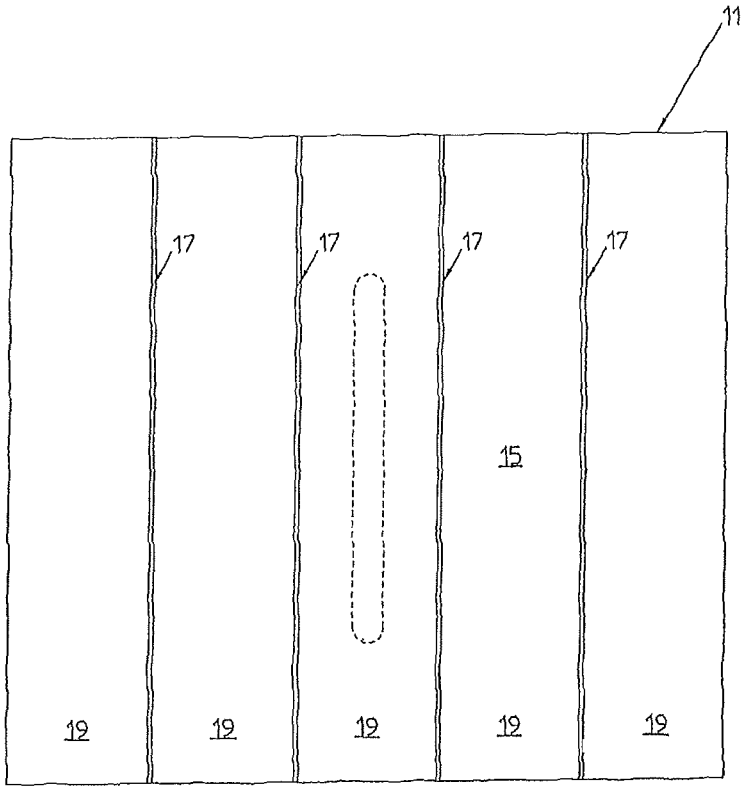
FIG. 3A, FIG. 3B and FIG. 3C show in top, frontal and side view respectively a first replaceable filler part.
Figure 3C:
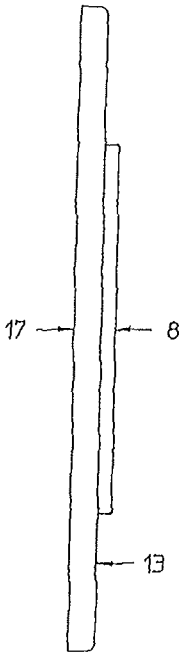
Figure 3B:
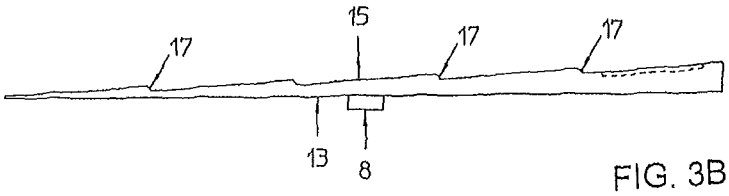

FIGS. 3A-C show in top, frontal and side view respectively a first replaceable filler part embodied as a wedge 11 that is intended to come to rest with its bottom surface 13 on a baseplate mounted on a sleeper.

Figure 4A:
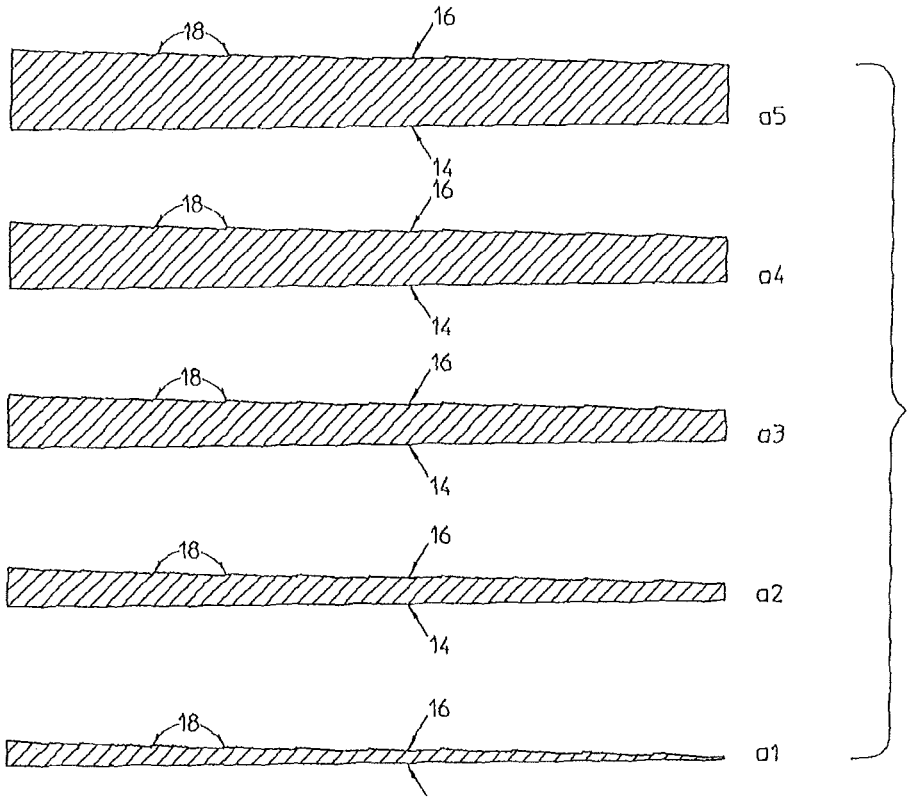
FIG. 4A and FIG. 4B show in side and top view respectively a second replaceable filler part.
Figure 4B:
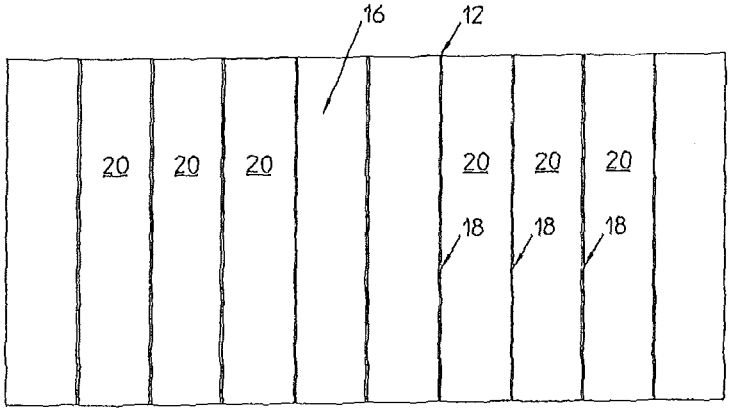

FIGS. 4A-B show in side and top view respectively a second replaceable filler part embodied as a wedge 12, having a side 14 that in use abuts against the underside of the rail 1.

The wedges 11, 12 have matching oblique contacting surfaces 15, 16, whereby in use the oblique surfaces 15, 16 of the first wedge 11 and the second wedge 12 rest on each other so as to cause that opposed surfaces 13, 14 of the first wedge 11 and the second wedge 12 that contact the rail 1 and the baseplate 2 on the sleeper are substantially horizontal. The said oblique surfaces 15, 16 are provided with a rough contact surface to counteract mutual displacement of the said wedges 11, 12. Further the wedges 11, 12 have in the longitudinal direction of their oblique contacting surfaces 15, 16 regularly distributed depressions 17, 18 so as to arrange that in said longitudinal direction the oblique contacting surface 15, 16 of each wedge 11, 12 is shaped as a series of connected sloping surface-parts 19, 20. This makes it easy to accommodate for variable dimensions of the room or space 7 between the rail 1 and the baseplate 2 mounted on a sleeper, whilst the cooperating depressions on the contacting surfaces 15, 16 of the abutting wedges 11, 12 also secure against longitudinal movement of these wedges.

FIGS. 3A and 3C show that the wedge 11 or filler part that immediately comes to rest on the baseplate on the sleeper has side guides 21, each guide 21 being in use positioned on an opposite side of the supported rail 2.

It can further be remarked that the wedges 11, 12 or filler parts are preferably made from an elastic material, such as nylon or HDPE, optionally reinforced with glass fiber.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A railway comprising rails supported by and mounted on baseplates, wherein each baseplate is fixed to a sleeper resting on ballast, and wherein each rail is clamped to the baseplate with a clamping plate that is fitted to the baseplate with a clamping bolt, and which clamping plate has opposite extremities of which a first extremity rests on a cam provided on the baseplate and a second extremity rests on and presses the rail to the baseplate, wherein between each rail and the baseplate there is a room or space which is provided with at least two replaceable filler parts that are placed on top of each other and together exhibit a thickness in the vertical direction that matches and fills said room or space between the rail and the baseplate so as to cause that the rail can be maintained at a pre-established level, wherein the room or space between the rail and the baseplate is selectable at a predefined measure corresponding to a selectable height of the rail between a first lowest position of the rail and a second highest position of the rail, wherein in the lowest position of the rail the first extremity of the clamping plate resting on the cam is above the second extremity of the clamping plate resting on the rail, and wherein in the highest position of the rail the first extremity of the clamping plate resting on the cam is below the second extremity of the clamping plate resting on the rail so as to arrange that with variation of the height of the rail the clamping plate rotates having its center of rotation on top of the cam, and further wherein the upper surface of the cam has an upwards inclination away from the rail so as to arrange that a position where the first extremity of the clamping plate rests on the cam shifts upwards and away from the rail with variation of the height of the rail from its first lowest position to its second highest position.

2. The railway according to claim 1, wherein the cam is provided on the baseplate at a far end from the rail.

3. A railway comprising rails that are supported by and mounted on baseplates, wherein each baseplate is fixed to a sleeper resting on ballast, and wherein each rail is clamped to the baseplate with a clamping plate that is fitted to the baseplate with a clamping bolt, wherein between each rail and the baseplate there is a room or space which is provided with at least two replaceable filler parts that are placed on top of each other and together exhibit a thickness in the vertical direction that matches and fills said room or space between the rail and the baseplate so as to cause that the rail can be maintained at a pre-established level, and further wherein the filler part that immediately rests on the baseplate and the baseplate have a cooperating protrusion and receptacle for the protrusion.

4. The railway according to claim 3, wherein the baseplate is provided with upstanding flanges between which the rail is placed, characterized in that the upstanding flanges are oblique with respect to an upper surface of the baseplate so as to arrange that in use the flange's sidewalls adjacent to the rail are oriented perfectly perpendicular to the horizon.

5. The railway according to claim 3, wherein a first and a second of the two replaceable filler parts are each embodied as wedges sloping in the longitudinal direction of the rail and having matching oblique contacting surfaces, whereby in use the oblique surfaces of the first wedge and the second wedge rest on each other so as to cause that opposed surfaces of the first wedge and the second wedge that contact the rail and the baseplate mounted on the sleeper are substantially horizontal, characterized in that said oblique surfaces are provided with a rough contact surface.

* * * * *